US005634738A

United States Patent [19]

Jackson et al.

[11] Patent Number: 5,634,738

[45] Date of Patent: Jun. 3, 1997

[54] VEHICLE ARRESTING SYSTEM

[76] Inventors: Martin A. Jackson; John M. Rhatigan, both of c/o The Entwistle Company, Bigelow St., Hudson, Mass. 01749

[21] Appl. No.: 549,508

[22] Filed: Oct. 27, 1995

[51] Int. Cl.[6] ..... F01F 13/00

[52] U.S. Cl. ..... 404/6; 49/9; 49/34; 49/49

[58] Field of Search ..... 404/6; 49/9, 34, 49/49, 404

[56] References Cited

U.S. PATENT DOCUMENTS

| | | | |
|---|---|---|---|
| 1,929,859 | 10/1933 | Strauss | 49/9 X |
| 2,237,106 | 4/1941 | Minert | 49/9 |
| 2,251,699 | 8/1941 | Banschbach | 49/9 |
| 2,324,726 | 7/1943 | Sawyer | 49/9 X |
| 2,336,483 | 12/1943 | Hoover | 49/9 |
| 2,440,574 | 4/1948 | Cotton | 49/9 X |
| 2,450,328 | 7/1948 | Cotton | 49/9 X |

*Primary Examiner*—Tamara L. Graysay
*Assistant Examiner*—Frederick L. Lagman
*Attorney, Agent, or Firm*—Jerry Cohen; Jacob N. Erlich

[57] ABSTRACT

A restraining barrier assembly is positionable across a roadway in a deployed position to define a restraining zone and may be moved vertically to a passive position. The barrier may be a rectangular net with wires (or cable) (21, 22, 23) spanning the net and a lower wire 24 below the net assuring effective trapping of autos and trucks of a variety of heights (of the vehicles and of their forward bumpers, hood and driver compartment sections) and a variety of spans between their bumpers and their forward wheels. Vertical strips (25, 26) are provided at intervals along the span of the barrier to maintain spacing of the wires from each other and relative to ground level. The lowest wire (24) is set back from the plane of the barrier that includes the mid-height and upper wires.

3 Claims, 2 Drawing Sheets

VEHICLE ARRESTING SYSTEM

BACKGROUND OF THE INVENTION

The present invention relates to systems for traffic control and more particularly to energy absorbing barriers moved into and out of a roadway at railroad grade crossings. The related co-pending application of Martin A. Jackson, et al., of common assignment herewith, Ser. No. 08/549,510, filed of even date herewith and entitled ENERGY ABSORBING BARRIER SYSTEM WITH CRASH INDICATION, discloses apparatus of this class, including a net which can be raised to a stowed position or deployed for safety purposes. The net and related deployment and retraction apparatus are parallel to and near a railroad track at a grade crossing and lowered when the train is going by to catch a car or truck that ignores visual and audible stop signals. An energy absorbing metal cable or strip payout mechanism absorbs the full momentum of the car or truck and stops it short of the track. If there is no such accident, the net is retracted to a stowed position in readiness for deployment when a next train approaches the crossing. However, there remains a need to provide apparatus of this class of devices that will perform its usual functions for most types of cars and trucks and also stop low-slung sports cars without detriment to its effectiveness for other vehicles and to deployment and retraction functions.

The object of the invention is to fulfill such need(s) with energy absorbing apparatus that can be reliable and quickly replaced and removed at grade crossings.

A further object of this invention is the provision of a universal net that can engage and stop cars and trucks.

SUMMARY OF THE INVENTION

In accordance with the invention the foregoing object is met by a restraining barrier installation that comprises vertical columns spanning a roadway or like traffic lane, elevatable holders riding on the columns, a restraint wall, with some flexibility, mounted on the holders and spanning the roadway. An energy absorbing mechanism is provided at each of the holders to play out a metal cable or strip that holds the wall to the holder in a way that absorbs the vehicle momentum and enables the vehicle to be stopped short of the railroad track taking loads of 2,000–80,000 pounds from 30–50 mph to zero within about 30 yards—a practical order of magnitude of spacing from the installation to the grade crossing.

The restraining wall has multiple essentially parallel arresting cables or wires in substantially a single plane. They are tied to each other by cross-ties. Optionally additional cross wires and/or netting can be provided in the restraint wall.

The restraint wall also has an arresting cable or wire, below a main portion, that can be placed at a height to catch a low undercarriage vehicle portion while avoiding the wheels of a truck—about 6–18 inches above grade. The wall bottom (exclusive of the low wire) is about a foot above the low wire. One or more mid-height wires and a high wires are also provided in the wall. Vertical props are provided for assuring low wire and wall height relation to each other and to the ground. The lower restraining wire is placed behind the wall (relative to an oncoming vehicle) to assure that the mid-height wire and a wall portion will engage the vehicle before the lower wire does. This assures that the vehicle will not over-ride the lower wire and will be engaged by at least the lower and mid-height wires. Wires as used herein refers to rod, strip and cabling strung out as wires. Cabling of twisted together or braided strands of high tensile metal or high tensile plastic is preferred. Galvanized-coated steel wires are the preferred metal wire components.

An auto crashing into the flexible wall (and the lower wire) loads the energy absorbing mechanism to impart an increasing resistance to the vehicle momentum. The energy absorber comprises units in each of the side holders of the wall, each of which comprises a rolled up metal tape (thick metal strip) connected between a pay-out point within the holder and an end of the flexible wall. The pay-out point is a mechanism for causing energy absorption by bending the elongated metal wire or strip within its elastic range of deformation in multiple steps that can be effected quickly because of low inertia of the system. The number and type of bends and thickness and area of the metal can be set for a specification threat of auto speed and weight in relation to tolerable run-out length. The energy absorbing structure, per se, is of the class described in the above cited co-pending application and in prior U.S. patents of Jackson (alone or with Van Zelm and/or Knickel) U.S. Pat. Nos. 2,979,163, 2,980,213, 3,017,163, 3,211,260 and 3,366,353, the disclosures of which are incorporated herein by reference as though set out at length herein. Such units can be operated in tandem arrays for load limiting, e.g. to deal with over-specification high speed auto or truck crashing the barrier. After a crash arrest, the apparatus can be reset by replacement of metal spool(s) in the energy absorbing mechanisms restraint holder(s). The columns do not need replacing. Reuse of flexible walls is optional. The up/down drives for the holders on the columns can be individual or based on a common motor at one of the columns or on the trestle with a drive linkage passing through the trestle. The elevating mechanism can be of lead screw, hydraulic or chain drive forms. Automatic and/or manual controls are provided to sense a need or timing for holder accelerating or descending drive and locking at upper, lower or (in some cases) intermediate height positions.

Other objects, features and advantages will be apparent from the following detailed description of preferred embodiments taken in conjunction with the accompanying drawings in which:

DETAILED DESCRIPTION OF PREFERRED EMBODIMENTS

Figure 1:
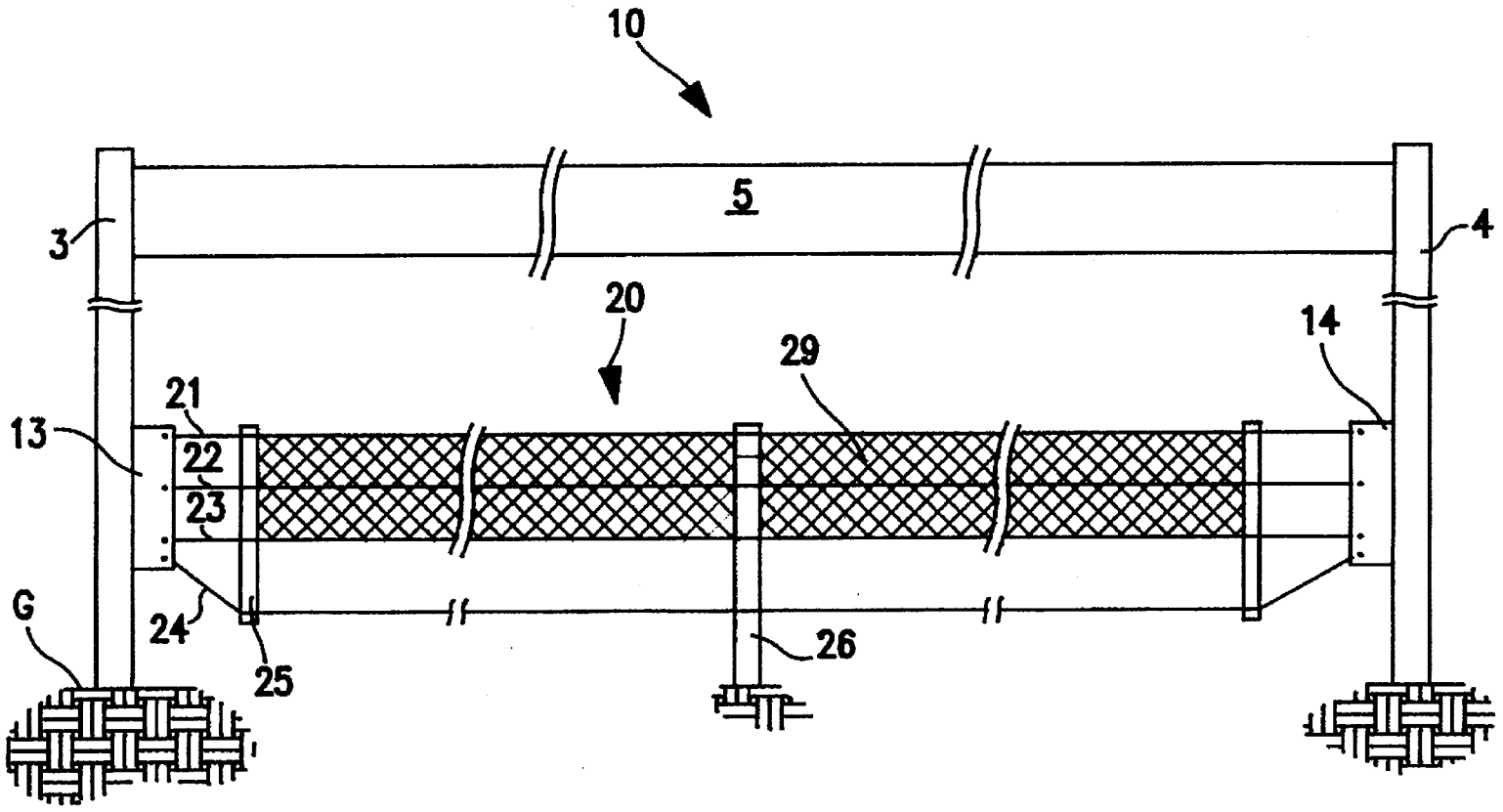
FIG. 1 is a front view (as seen from a vehicle approaching the grade crossing) of a vehicle arresting system constructed in accordance with a preferred embodiment of the present invention, with the barrier in a deployed position.

Referring now to FIGS. 1–4, the system 10 comprises towers 3, 4 and a roof crossing 5 (which can serve as a storage location for a retracted wall). Transport systems (elevators) 13 and 14 are provided on towers 3, 4, respectively. Each transport system supports ends of the barrier assembly 20, which comprises cables 21, 22, 23, 24, clamping assemblies or strips 25 and ground (G) supports 26 tied to certain of the clamp assemblies. Bolts 27 and nuts 28 are provided at locations B to tie strip elements 25-1 and 25-2 together about the cables and to hold 25 and 26 together. Only one end of barrier assembly 20 is shown; the other end is a mirror image.

Figure 2:
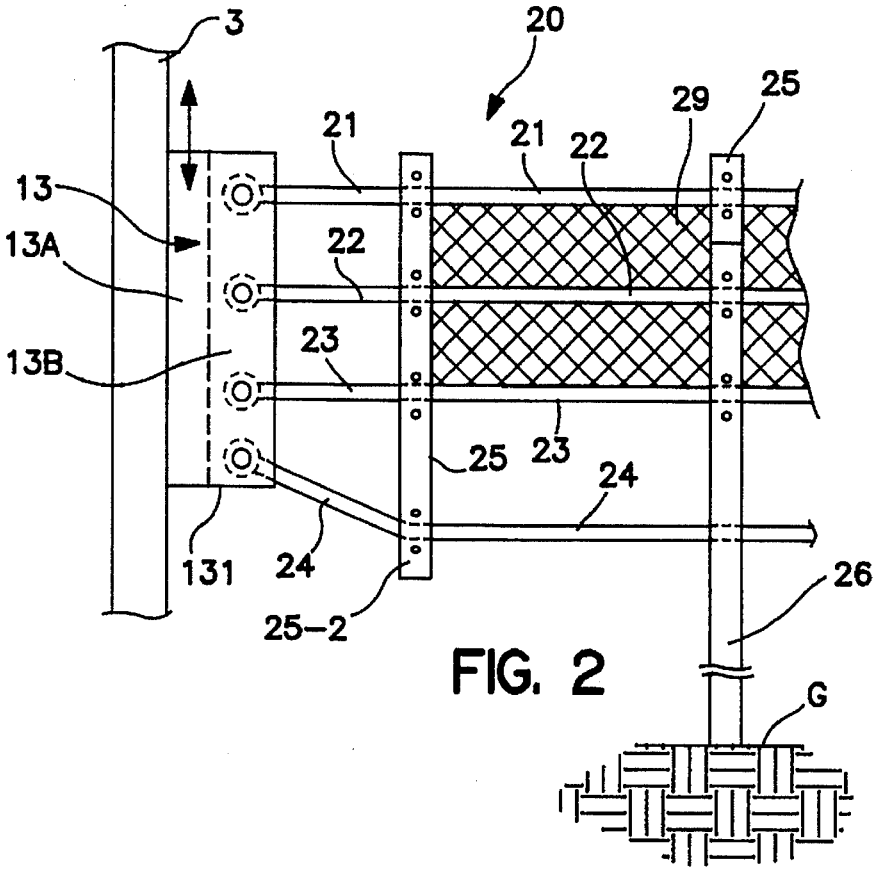
FIG. 2 is a partial front view of the net portion of the system and cables or wires related to the wall.
Figure 3:
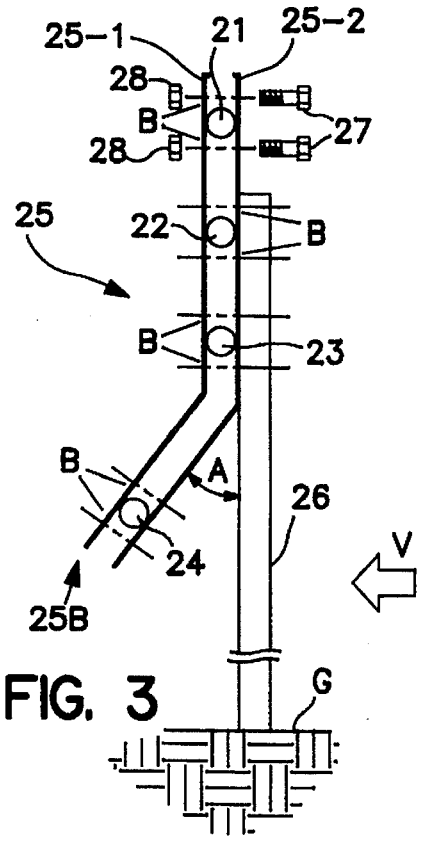
FIG. 3 is a side view.
Figure 4:
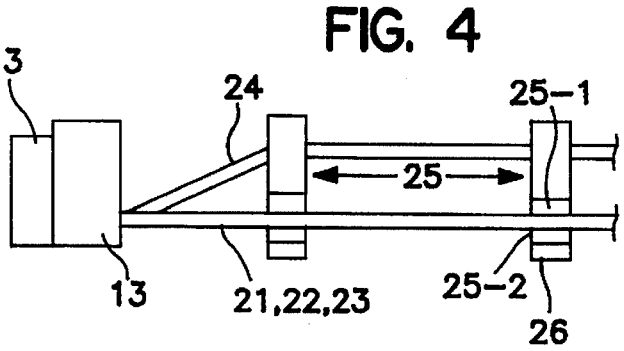
FIG. 4 is a partial top view of the wall portion.

As shown in FIG. 2 the transport system 13 (and similarly the transport system 14 of FIG. 1, not shown in FIG. 2) has a holder 131 with segments 13A, 13B, the latter (13B) being detachable to play out at the end of a steel tape (not shown). The steel tape is spooled up on a reel or the like and plays out through a bending die as explained in the above cited patents.

The bend back of strips 25 relative to a vehicle approach (arrow V, FIG. 3) is in an angle A range of 30 to 60 degrees and, as mentioned above, cable 24 is at 6–18 (preferably about a foot) inches above the ground and a foot (plus or minus 6 inches) below the net bottom and cable 23. These features serve to give a proper sequence of engagement of a vehicle so that the barrier assembly will not be dragged under the vehicle with a high bumper and/or short bumper to front wheels horizontal distance, or allow a low slung car or other vehicle with a low bumper and front end, and/or long bumper to front wheels distance, to tunnel under the wires and net elements of the barrier assembly. The discovery of these problems and means for solution of the same arise through this invention. It is convenient to express horizontal bumper to front wheel distances as bumper to wheel axis distance. In the case of a truck that short distance and the large wheel (tire) size put the wheel essentially adjacent the front bumper. On the other hand making passenger vehicles (sports cars, some economy cars) have a long bumper to wheel axis distance and smaller wheels. The set back (angle, distance) of the lower wire relative to the wall accommodates that whole range of differences.

Strips 25 are spaced at 2–4 foot intervals and strips 26, whether or not combined with strips 25 as shown, are at 2–8 foot intervals. The wall or net 29 and cables 21, 22, 23, 24 are held taut by holders 131; they have very little sag or buckling and such limited tendency to sag as they have is counter-acted by the strips 25, 26.

The invention while described re its usage in railroad grade crossings above can also be used as a security device to prevent forced entrance of vehicles to buildings and grounds at gateways, at the ends of piers and for other purposes equivalent to grade crossing usage.

It should be noted that bi-directionality can be established easily by reversal of the orientation of strips 25 (i.e. having lower portions 25B angle back in a direction opposite to the one shown).

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A restraining barrier system to stop road vehicles comprising:

(a) means defining a barrier assembly comprising a flexible wall having a bottom spanning a roadway for such vehicles and at least one low wire disposed a distance below and behind the wall, the wall having a height of at least four feet, (b) means for deploying the barrier assembly to a deployed position where the low wire is about a foot above the ground and the wall bottom about a foot above the low wire and for retracting the assembly from such position to allow vehicle passage, (c) means defining first and second transport means supporting the assembly at ends thereof and drivable by said means for deployment and retraction, (d) energy absorbing means constructed and arranged in case of crash of a vehicle into at least one of the wall and low wire to play out a connector and thereby allow wall and low wire movement in a way that absorbs momentum of the vehicle and stops it with a low rate of deceleration, and (e) the said low wire distance behind and below the wall being sufficient to assure capture of a low vehicle with a long bumper-forward wheel axis distance while avoiding capture of the wall under forward wheels of a high vehicle with a low bumper-forward wheel axis distance.

2. The apparatus of claim 1 and further comprising multiple additional wires spanning the wall in its span direction.

3. The apparatus of claim 2 and further comprising vertical strips arranged along the wall and maintaining a relative spacing of the wall and wires.

* * * * *